US005704858A

United States Patent [19]

Yang

[11] Patent Number: 5,704,858

[45] Date of Patent: Jan. 6, 1998

[54] SAFETY BASEBALL

[76] Inventor: Wen Hsiang Yang, No. 201, Chong Don Street, Kaohsiung, Taiwan

[21] Appl. No.: 805,930

[22] Filed: Feb. 25, 1997

[51] Int. Cl.[6] ..... A63B 37/06

[52] U.S. Cl. ..... 473/602; 473/601

[58] Field of Search ..... 473/598, 600, 473/601, 602, 603, 604, 605, 607, 134, 135, 136, 137, 157, 158, 159

[56] References Cited

U.S. PATENT DOCUMENTS 3,976,295 8/1976 Heald, Jr. ..... 473/601
4,772,019 9/1988 Morgan ..... 473/601
5,007,639 4/1991 Watson et al. ..... 473/602
5,123,659 6/1992 Williams ..... 473/601

*Primary Examiner*—Steven B. Wong
*Attorney, Agent, or Firm*—Charles E. Baxley, Esq.

[57] ABSTRACT

A baseball includes a spherical core of foamable material and three layers of foamable material engaged on the spherical core and a cover layer engaged on the three layers. The intermediate layer of the three layers includes a hardness and a density greater than that of the other two layers and less than that of the spherical core, for allowing the other two layers to form a cushioning device and for preventing the players from being hurt by the baseball.

1 Claim, 2 Drawing Sheets

SAFETY BASEBALL

BACKGROUND OF TEE INVENTION

1. Field of the Invention

The present invention relates to a baseball, and more particularly to a safety baseball.

2. Description of the Prior Art

One typical baseball is disclosed in U.S. Pat. No. 3,976, 295 to Heald, Jr. and comprise a hard cover and a soft cover engaged in the hard cover. However, the hard cover may hurt the player, particularly the children.

The present invention has arisen to mitigate and/or obviate the afore-described disadvantages of the conventional baseballs.

SUMMARY OF THE INVENTION

The primary objective of the present invention is to provide a safety baseball having a soft outer portion for preventing the children from being hurt.

In accordance with one aspect of the invention, there is provided a baseball including a spherical core of foamable material and three layers of foamable material engaged on the spherical core and a cover layer engaged on the three layers. A first of the layers is engaged on the spherical core, a second of the layers is engaged on the first layer, and a third of the layers is engaged on the second layer. The second layer of the body includes a hardness and a density greater than that of the first layer and that of the third layer and less than that of the spherical core, for allowing the first layer and the third layer to form a cushioning device.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
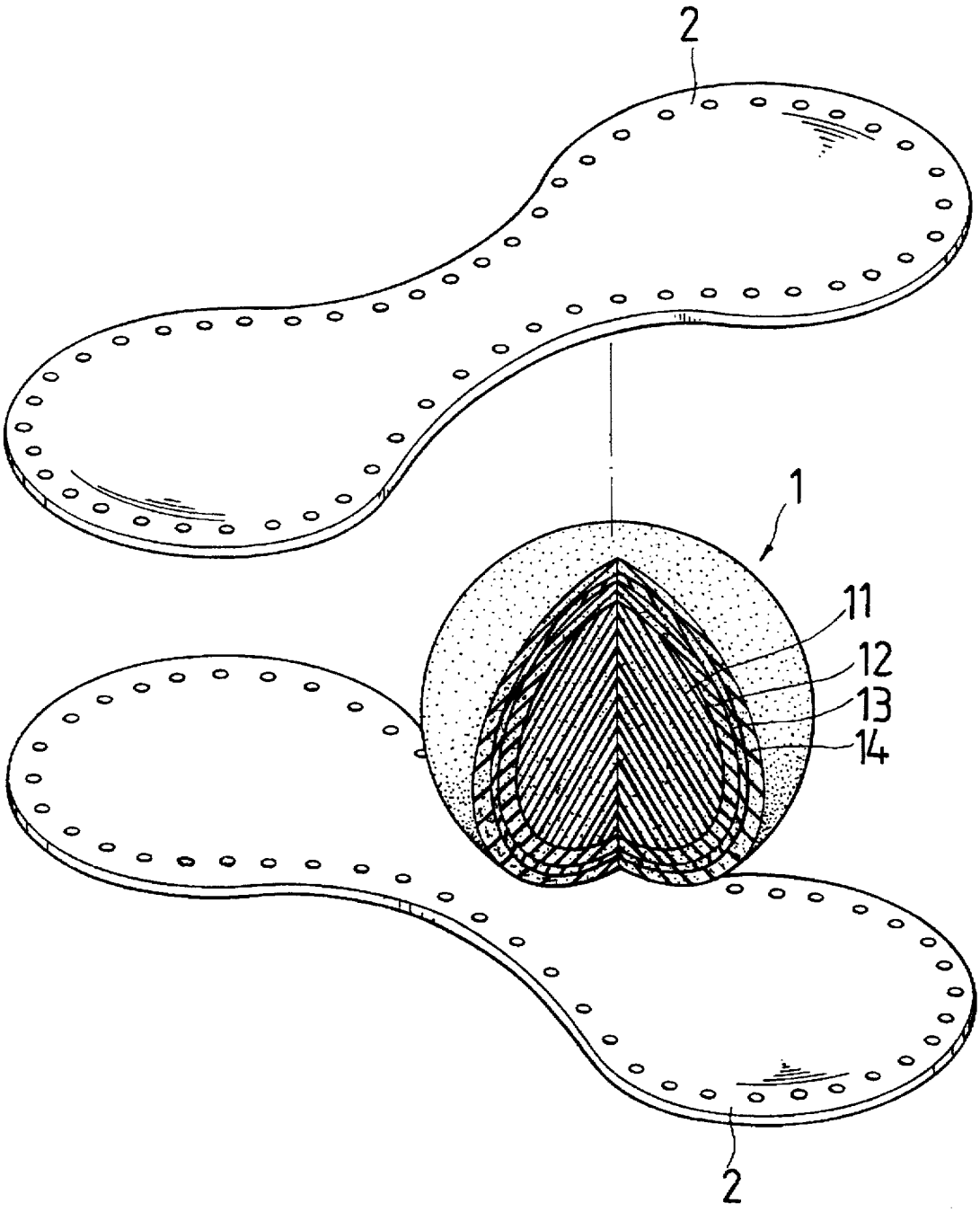
FIG. 1 is a partial exploded view of a safety baseball in accordance with the present invention.
Figure 2:
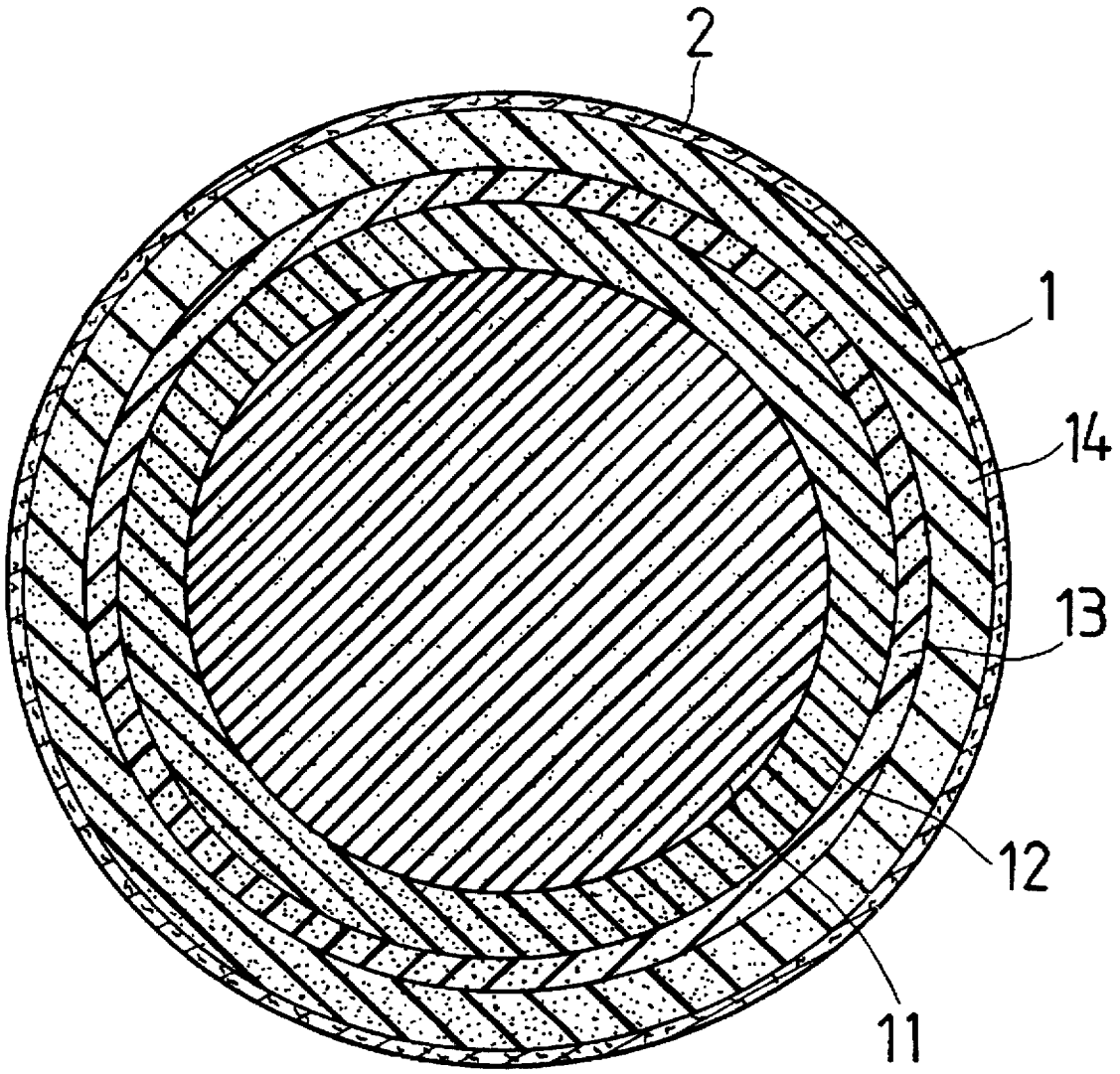
FIG. 2 is a cross sectional view of the safety baseball.

Referring to the drawings, a safety baseball in accordance with the present invention comprises a body 1 including a spherical core 11 made of foamable material and having a great hardness and a great density. Three layers of foamable materials 12, 13, 14 are engaged on the spherical core 11, in which the the second layer 13 includes a hardness and a density less than that of the spherical core 11 but greater than that of the first layer 12 and the third layer 14. The spherical core 11 and the three layers 12, 13, 14 are disposed in a mold device and are hot-pressed for allowing the foamable materials to be expanded and formed. The three layers 12–14 and the core 11 may thus be solidly fused or secured together. The baseball further includes a cover leather layer 2 which is typically made of horsehide and which is stitched over or enclosing the body 1.

It is to be noted that the third layer 14 includes a less density and a less hardness so as to form a soft cushioning layer and so as to prevent the player from being hurt by the baseball. In addition, the first layer 12 of softer characteristic is engaged between the core 11 and the second layer 13 of greater hardness such that the first layer 12 also forms a cushioning layer for absorbing vibrations and shocks. The second layer 13 maintain the baseball a suitable hardness.

Accordingly, the safety baseball in accordance with the present invention includes a first layer 12 and a third layer 14 for forming a shock absorbing layers and for forming a softer outer portion so as to prevent the players from being hurt by the baseball.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A baseball comprising:

a body including a spherical core of foamable material, and three layers of foamable material engaged on said spherical core, a first of said layers being engaged on said spherical core, a second of said layers being engaged on said first layer, and a third of said layers being engaged on said second layer, and a cover layer engaged on the body, said second layer of said body including a hardness and a density greater than that of said first layer and that of said third layer and less than that of said spherical core, for allowing said first layer and said third layer to form a cushioning device.

* * * * *